US007798860B2

(12) United States Patent
Yuan

(10) Patent No.: US 7,798,860 B2
(45) Date of Patent: Sep. 21, 2010

(54) ELECTRICAL CONNECTOR WITH IMPROVED HOUSING

(75) Inventor: Wei Yuan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/496,665

(22) Filed: Jul. 2, 2009

(65) Prior Publication Data

US 2010/0003845 A1 Jan. 7, 2010

(30) Foreign Application Priority Data

Jul. 2, 2008 (CN) ..... 2008 2 0040266

(51) Int. Cl.
*H01R 24/00* (2006.01)

(52) U.S. Cl. ..... 439/637

(58) Field of Classification Search ..... 439/637, 439/873, 660, 876, 367
See application file for complete search history.

(56) References Cited

U.S. PATENT DOCUMENTS 5,213,514 A * 5/1993 Arai ..... 439/79
5,639,269 A * 6/1997 Vanbesien et al. ..... 439/741
6,290,547 B2 * 9/2001 David et al. ..... 439/701
6,575,775 B2 * 6/2003 Hasegawa et al. ..... 439/188
7,037,146 B2 * 5/2006 Nakamura ..... 439/751
7,044,812 B2 * 5/2006 Fry et al. ..... 439/876
7,086,913 B2 * 8/2006 Myer et al. ..... 439/876
7,114,963 B2 * 10/2006 Shuey et al. ..... 439/79
7,331,802 B2 * 2/2008 Rothermel et al. ..... 439/108

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

An electrical connector (1) includes an insulative housing (2) and at least one contact (3) received in the housing. The housing defines a receiving cavity (23) therein, at least one receiving groove (216) communicating with the receiving cavity, a recessing groove (219) recessing outwards from an inner face (2161) of the at least one receiving groove and a locking hole (218) recessing outwards from an inner face (2190) of the recessing groove. The at least one contact defines a base portion (31) received in the receiving groove and an elastic arm (32) extending from the base portion and projecting into the receiving cavity, and the base portion defines an elastic locking portion (312) passing through the recessing groove and projecting into the locking hole in an elastic deformation manner to lock with the locking hole.

13 Claims, 4 Drawing Sheets

ELECTRICAL CONNECTOR WITH IMPROVED HOUSING

BACKGROUND OF THE INVENTION

1. Field of the Invention

The present invention relates to an electrical connector, and particularly to an electrical connector defining an insulative housing having a recessing groove for reducing frictional force when contacts are inserted into the housing.

2. Description of the Related Art

An electrical connector is widely used in electrical equipments to mate with a complementary connector and electrically connect with a print circuit board to provide an electrical connection between two electrical equipments. Usually, the electrical connector defines an insulative housing and at least one contact retained in the housing. The housing defines a receiving groove for receiving the at least one contact, and a locking hole communicating with the receiving groove. The at least one contact defines a base portion, a contacting portion extending from one end of the base portion and a soldering portion, and the base portion defines an elastic piece projecting outwards at a middle portion thereof. During the assembly of the at least one contact, the base portion enters into the receiving groove and attaches to the inner surface of the receiving groove, and the elastic piece is pressed to be deformed by the inner surface and then moves along the inner surface until entering into the locking hole to relax to be a normal state. But the elastic piece is badly deformed during the assembling, which may produce a big frictional force to prevent the at least one contact from moving smoothly along the inner surface of the receiving groove, and the at least one contact is very hard to be inserted into the housing.

Hence, a new design having an improved housing of a connector is provided.

SUMMARY OF THE INVENTION

Accordingly, an object of the present invention is to provide an electrical connector having an improved housing.

In order to achieve the object set forth, an electrical connector includes an insulative housing and at least one contact received in the housing. The housing defines a receiving cavity therein, at least one receiving groove communicating with the receiving cavity, a recessing groove recessing outwards from an inner face of the at least one receiving groove and a locking hole recessing outwards from an inner face of the recessing groove. The at least one contact defines a base portion received in the receiving groove and an elastic arm extending from the base portion and projecting into the receiving cavity, and the base portion defines an elastic locking portion passing through the recessing groove and projecting into the locking hole in an elastic deformation manner to lock with the locking hole.

Other objects, advantages and novel features of the invention will become more apparent from the following detailed description of the present embodiment when taken in conjunction with the accompanying drawings.

DETAILED DESCRIPTION OF THE INVENTION

Figure 1:
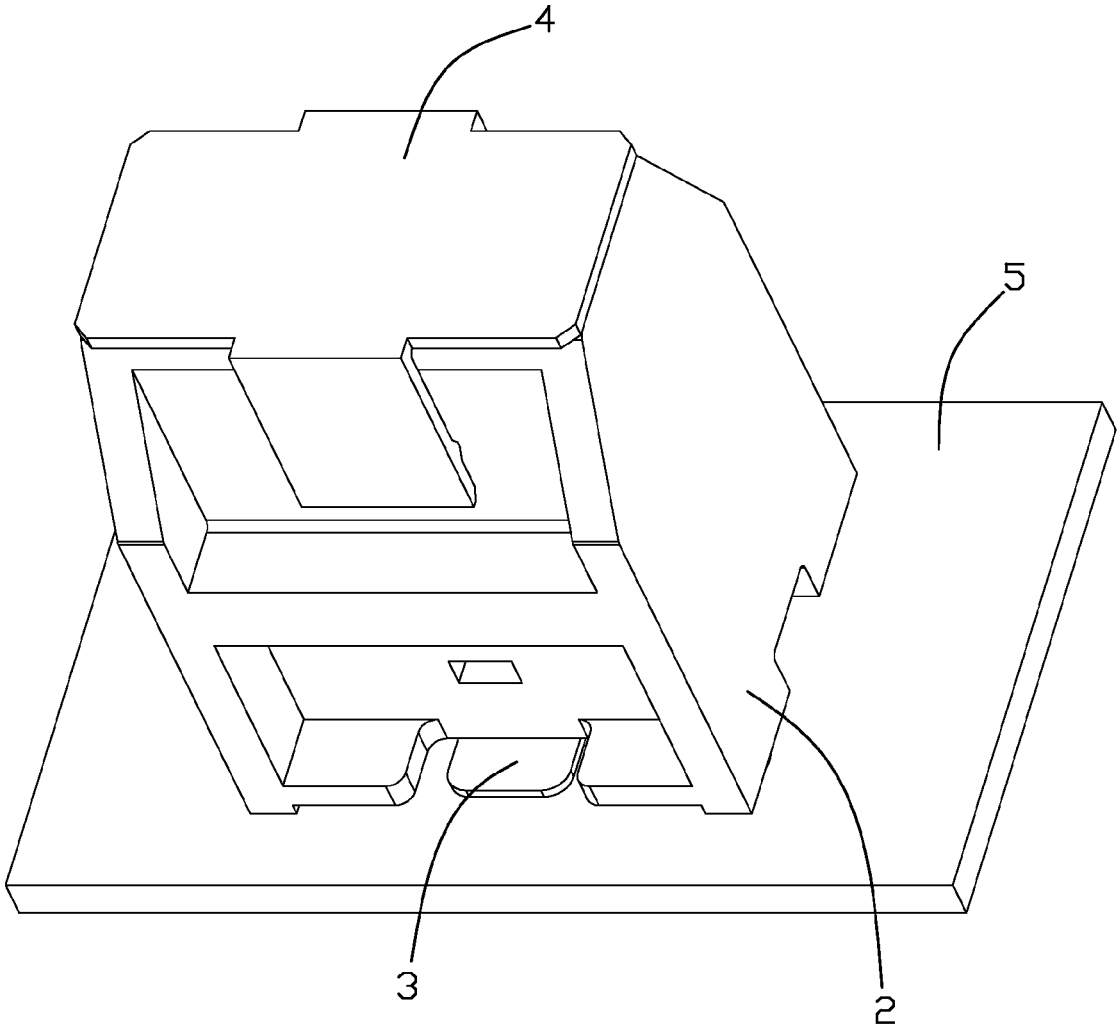
FIG. 1 is a perspective view of an electrical connector in accordance with a preferred embodiment of the present invention having a pick up device attached thereon and mounted on a PCB.

Reference will now be made to the drawing figures to describe a preferred embodiment of the present invention in detail.

Figure 2:
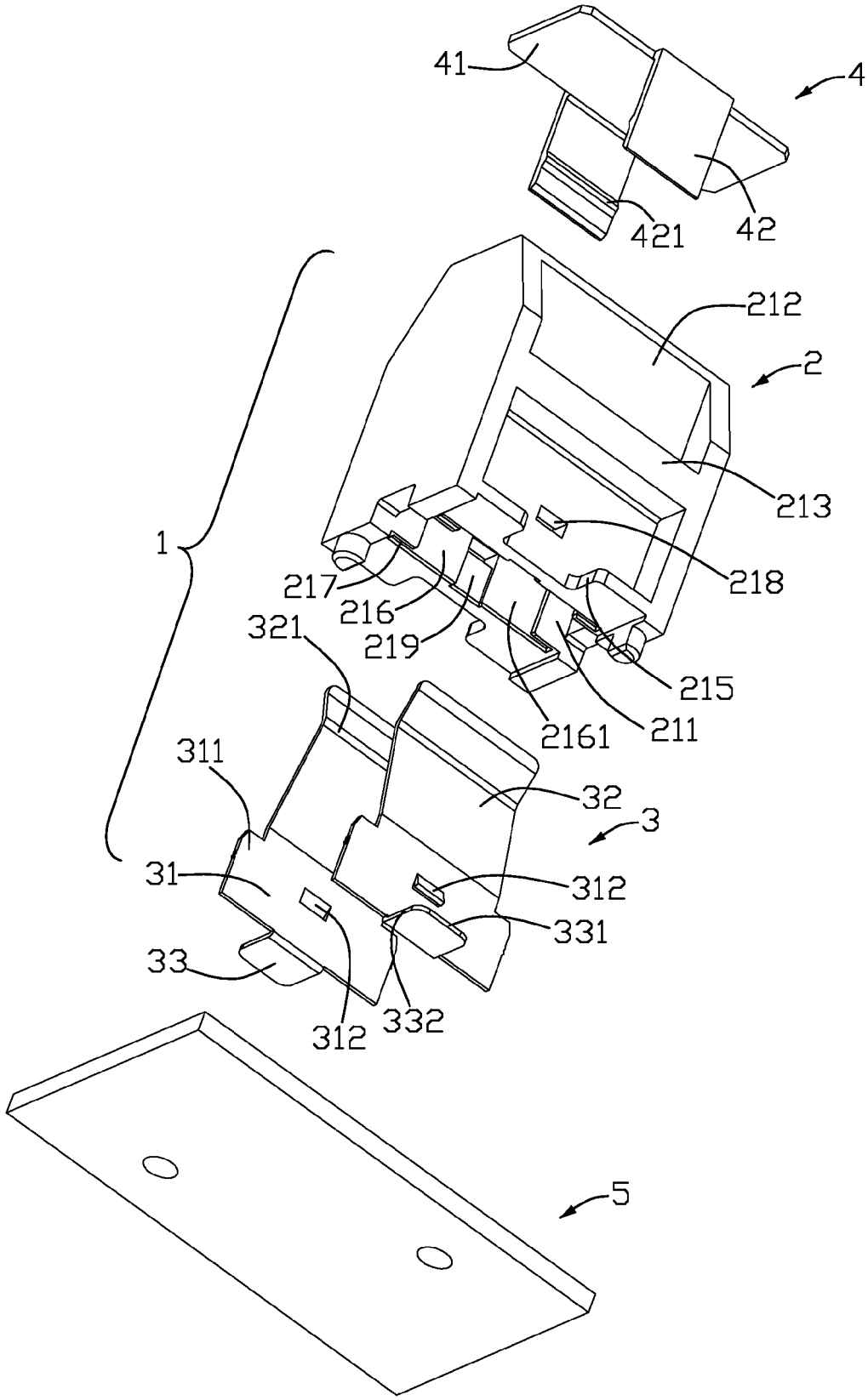
FIG. 2 is an exploded view of the electrical connector shown in FIG. 1.

Referring to FIG. 1 and FIG. 2, an electrical connector 1 mounted on a printed circuit board (PCB) 5 includes an insulative housing 2 and a pair of contacts 3 received in the housing. A pick up device 4 is attached on a top wall of the electrical connector, which is used to take the electrical connector 1 to the PCB 5 easily.

Figure 3:
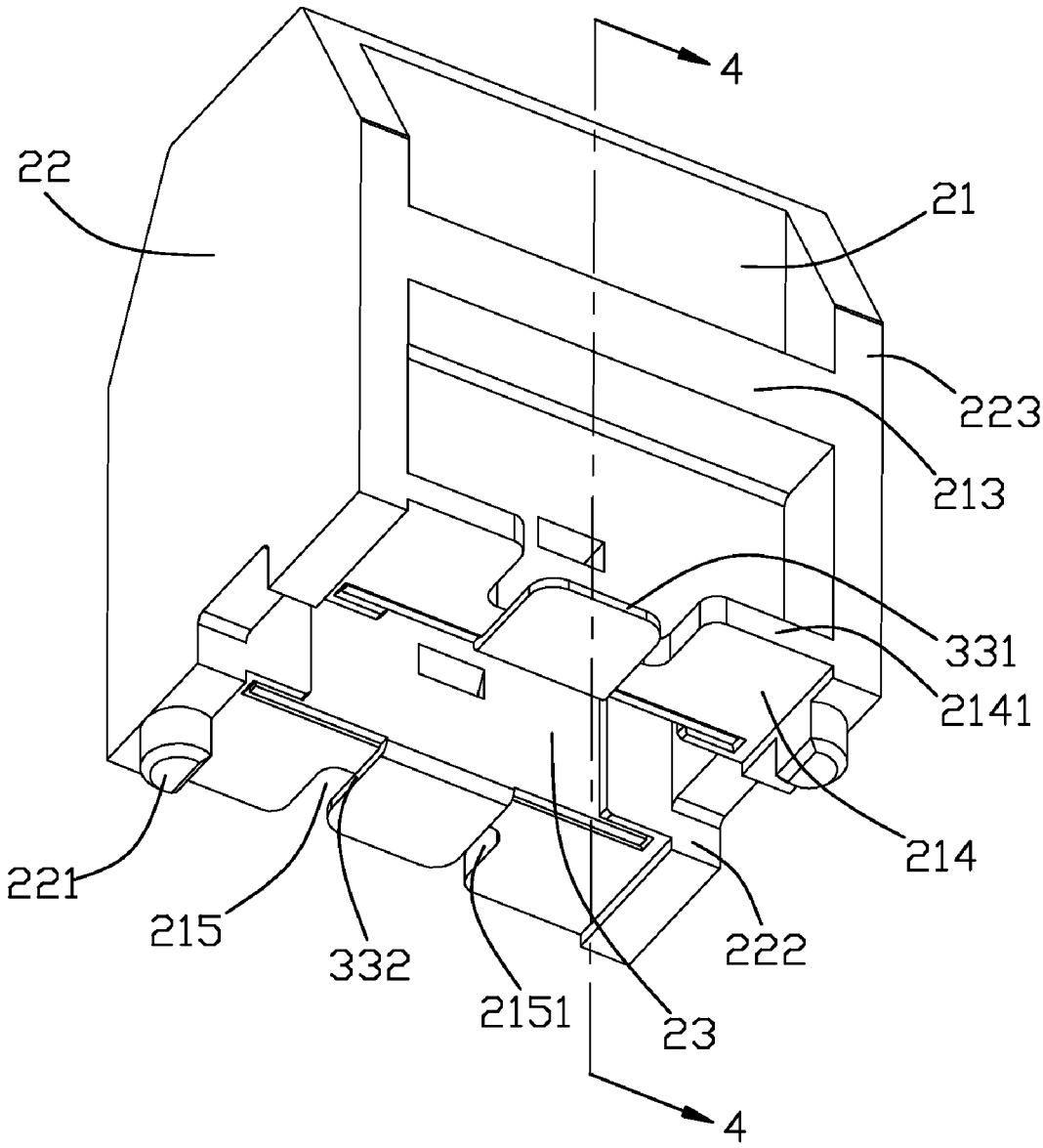
FIG. 3 is a perspective view of the electrical connector shown in FIG. 1.
Figure 4:
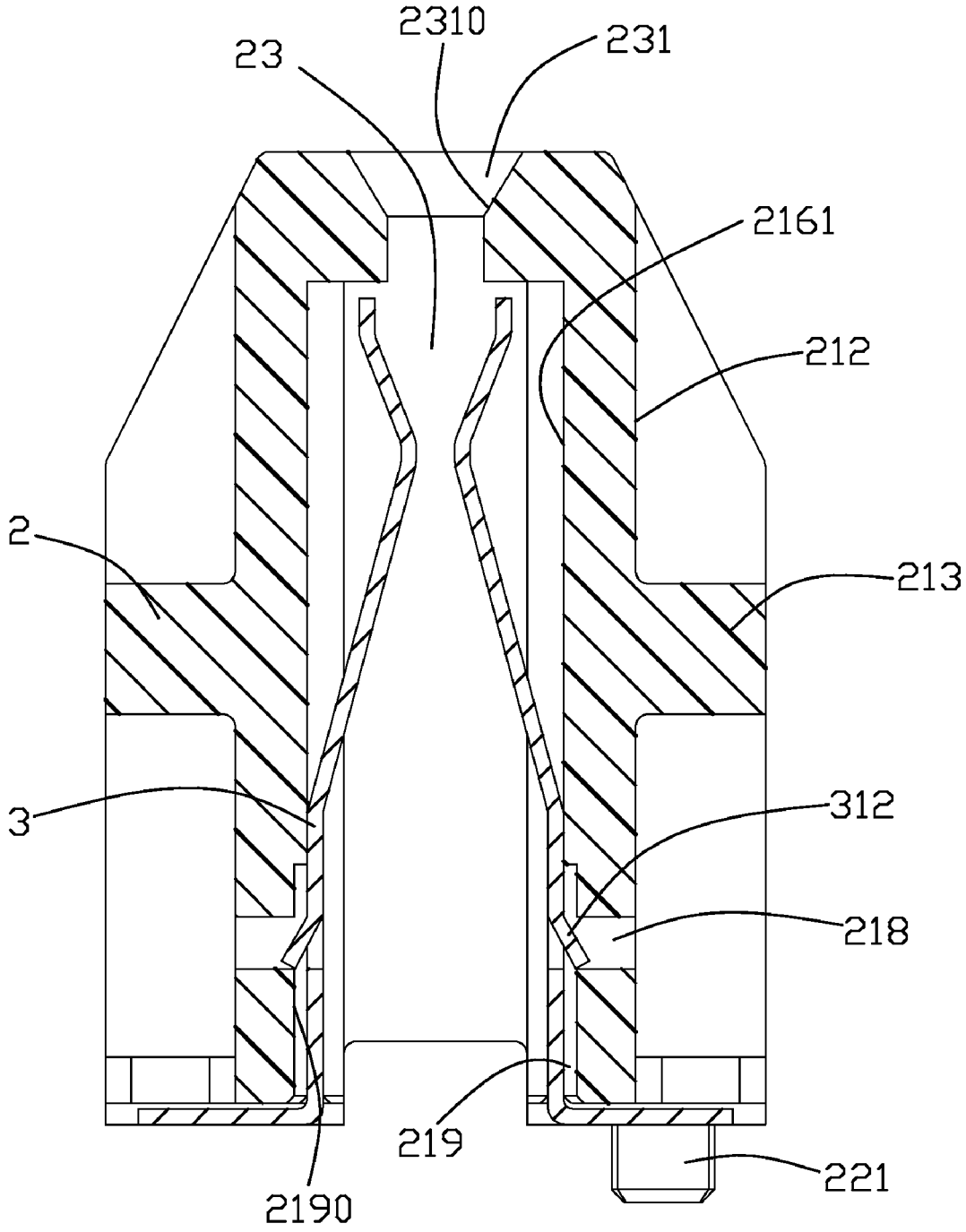
FIG. 4 is a cross-sectional view of the electrical connector taken along line 4-4 of FIG. 3.

Referring to FIG. 2 to FIG. 4, the insulative housing 2 defines a bottom wall 214, a top wall opposite to the bottom wall 214, a pair of opposite sidewalls 21 connecting with the top and bottom walls, and a pair of end walls 22 connecting with the sidewalls 21. A receiving cavity 23 runs through the opposite top wall and bottom wall 214 and provides an opening 231 on the top wall thereof, and the opening 231 further defines a guiding face 2310 extending slantways at the inner face for guiding a mating component to enter into the receiving cavity 23 smoothly. Each sidewall 21 defines an inner face 211 disposed in the receiving cavity 23 and an outer face 212 opposite to the inner face 211, and each end wall 22 defines a pair of wings 223 extending outwards and respectively beyond an outer face 212. Each sidewall 21 defines a girder portion 213 projecting outwards from the outer face 212 and connecting to the opposite wings 223 at a middle portion thereof, and the wings 223 and the girder portions 213 may reinforce intensity of the housing. The end walls 22 each define a bottom face adjacent to the bottom wall 214, and each bottom face defines an indentation 222 at a middle portion thereof for material escaping therethrough and a retaining post 221 extending downwards therefrom.

Each sidewall 21 further defines a receiving groove 216 recessed outwards from the inner face 211 and communicating with the receiving cavity 23, and a pair of retaining grooves 217 are provided at two opposite sides of the receiving groove 216. A recessing groove 219 further recesses outwards from a middle portion of an inner face 2161 of each receiving groove 216 at a lower portion thereof, and the recessing groove 219 communicates with the receiving groove 216 and does not run through the outer face 212. Each sidewall 21 further defines a locking hole 218 recessed outwards from an inner face 2190 of the recessing groove 219 and running through the outer face 212, and each recessing groove 219 is positioned between the corresponding receiving groove 216 and the locking hole 218 and communicates with the both. The recessing groove 219 and the locking hole 218 both recess along a direction perpendicular to the corresponding sidewall 21, and the locking hole 218 has a deeper recessing depth than that of the recessing groove 219.

Referring to FIG. 2 to FIG. 4, the contacts 3 are made from metal piece, and each contact 3 defines a board-shaped base portion 31, an elastic arm 32 extending upwards from top edge of the base portion 31 and a soldering portion 33 extending outwards and vertical to the base portion 31. The base portion 31 defines a pair of retaining portions 311 each extending from a side edge of the base portion, and an elastic locking portion 312 projecting outwards from a middle portion thereof. In this embodiment, the elastic locking portion 312 is defined as an elastic piece 312 punching from the base portion 31. Each contacts 3 is inserted into the housing 2 from the bottom wall thereof, and the elastic arm 32 firstly enters into the receiving cavity 23, and then the base portion 31 enters into the receiving groove 216 and the retaining portions 311 engages with the retaining groove 217. The elastic piece 312 enters into the recessing groove 219 and is pressed to be deformed elastically by the inner face 2190. The deformed elastic piece 312 moves along the inner face 2190 until the elastic piece 312 project into the locking hole 218 and relax to be a normal state to retain the contact 3 to the housing 2 steadily. At the same time, the base portion 31 attaches to the inner face 2161 of the receiving groove 216, and space from the inner face 2190 of the recessing groove 219, and contacting portions 321 on the elastic arms 32 project into the receiving cavity 23 and face to each other. The soldering portion 33 is disposed under the bottom wall 214 and expose through an indentation 215 defined at a middle portion of the bottom wall 214, and the outmost side edge 2141 of the bottom wall 214 extends beyond the outmost side edge 331 of the soldering portion 33 to prevent the soldering portion 33 from being destroyed. The projection of the side edge 2151 of the indentation 215 in the PCB 5 is apart from that of the adjacent side edge 332 of the soldering portion 33, which can prevent the housing from being destroyed during soldering and further more to achieve a good soldering effect.

Referring to FIG. 1 and FIG. 2, the pick up device 4 includes a board-shaped operating portion 41 and a pair of latching arms 42 extending downwards from two opposite side edges of the operating portion 41. The opposite latching arms 42 are both vertical to the operating portion 41, and each latching arm 42 defines a rib 421 facing to the outer face 212 of the sidewall 21. The pick up device 4 is retained to an upper portion of the housing 2, and the operating portion 41 is wholly covered on the top wall of the housing and the two latching arms 42 are respectively disposed in two opposite sides of the housing to clip the upper portion of the sidewalls 21, and the ribs 421 may engage with the corresponding outer faces 212 for further retaining the pick up device 4 to the housing 2.

At least part of the base portion 31 separate from the inner face with a gap to reduce friction between the base portion 31 and the inner face of the receiving cavity 23. The elastic piece 312 deforms with a little distance so as to produce a little friction force between the base portion 31 and the inner face of the receiving cavity 23. As a result, the contact 3 enters into the receiving groove with a small friction and easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a receiving cavity therein, at least one receiving groove communicating with the receiving cavity, a recessing groove recessing from an inner face of the at least one receiving groove and a locking hole recessing outwards from an inner face of the recessing groove, and the recessing groove communicating with both the at least one receiving groove and the locking hole; and at least one contact received in the housing, and defining a base portion received in the receiving groove and an elastic arm extending from the base portion and projecting into the receiving cavity, the base portion defining an elastic locking portion passing through the recessing groove and projecting into the locking hole in an elastic deformation manner to lock with the locking hole.

2. The electrical connector as described in claim 1, wherein the recessing groove recesses from a middle portion of the inner face of the at least one receiving groove at a lower portion thereof.

3. The electrical connector as described in claim 2, wherein the elastic locking portion is defined as an elastic piece punching from the base portion.

4. The electrical connector as described in claim 3, wherein the inner face of the recessing groove is disposed beyond the inner face of the receiving groove, and the base portion attaches to the inner face of the of the receiving groove and spaces from the inner face of the of the recessing groove.

5. The electrical connector as described in claim 4, wherein the elastic piece deforms elastically by being pressed by the inner face of the recessing groove while passes through the recessing groove.

6. The electrical connector as described in claim 1, wherein the recessing groove and the locking hole both recess in a direction perpendicular to the inner face of the receiving groove.

7. The electrical connector as described in claim 1, wherein the housing defines a pair of opposite sidewalls and a pair of opposite end walls connecting with the sidewalls and the receiving cavity is provided therebetween, and the at least one receiving groove recesses outwards from an inner face of each sidewall and the locking hole runs through an outer face of the sidewall opposite to the inner face.

8. The electrical connector as described in claim 7, wherein each sidewall defines a girder portion projecting outwards from the outer face and connecting to the end walls.

9. The electrical connector as described in claim 1, wherein the at least one contact defines a soldering portion extending from the base portion, and the soldering portion is disposed under a bottom wall of the housing and exposed to an indentation defined at the bottom wall, and the outmost side edge of the bottom wall extends beyond the outmost side edge of the soldering portion.

10. The electrical connector as described in claim 1, further comprising a pick up device retained to an upper portion of the housing, and the pick up device defining an operating portion and a pair of opposite latching arms extending from two opposite side edges of the operating portion for clipping the housing.

11. An electrical connector comprising:

an insulative housing defining a receiving cavity running through a mating face and a mounting face of the housing; and a pair of contacts inserted from the mounting face to the mating face, each contact comprising a contacting portion projecting into the receiving cavity, a base portion abutting against an inner face of the receiving cavity and a soldering portion located at the mounting face;

wherein the inner face of the receiving cavity has a recessed portion so that a part of the base portion is distanced from a bottom face of the recessed portion wherein the base portion defines a locking portion punching outwards to slide into a hole opening on the inner face of the receiving cavity.

12. An electrical connector comprising:

an insulative housing defining a receiving cavity;

an inner face formed beside said receiving cavity and defining a pair of retaining grooves by two sides;

a recessing groove inwardly recessed from the inner face;

a metallic contact defining a curved contacting section extending into the receiving cavity, and a planar base portion below said contacting section, said base portion having two opposite lateral edges received in the corresponding retaining grooves, an elastic lance stamped out from the base portion and dimensioned to comply with a width of the recessing groove so as to restrainedly move along the recessing groove; wherein a locking hole is formed in the housing behind the recessing groove so as to allow a free end of the elastic lance to spring outwardly thereinto once the contact is moved to a final position during upwardly assembling the contact to the housing.

13. The electrical connector as claimed in claim 12, wherein said contacting section is laterally offset from said pair of retaining grooves.

* * * * *